US011193272B2

(12) United States Patent
Milo

(10) Patent No.: US 11,193,272 B2
(45) Date of Patent: Dec. 7, 2021

(54) MOVABLE SCREEN

(71) Applicant: PROTEZIONI S.R.L, Veglie (IT)

(72) Inventor: Sara Milo, Veglie (IT)

(73) Assignee: PROTEZIONI S.R.L., Veglie (IT)

( * ) Notice: Subject to any disclaimer, the term of this patent is extended or adjusted under 35 U.S.C. 154(b) by 268 days.

(21) Appl. No.: 16/482,439

(22) PCT Filed: Mar. 1, 2018

(86) PCT No.: PCT/IB2018/051311
§ 371 (c)(1),
(2) Date: Jul. 31, 2019

(87) PCT Pub. No.: WO2018/163029
PCT Pub. Date: Sep. 13, 2018

(65) Prior Publication Data

US 2020/0040571 A1 Feb. 6, 2020

(30) Foreign Application Priority Data

Mar. 3, 2017 (IT) ..... 102017000024060

(51) Int. Cl.

| | |
|---|---|
| ***E04B 2/78*** | (2006.01) |
| ***E04B 2/74*** | (2006.01) |
| ***E04F 11/18*** | (2006.01) |
| ***E04H 17/16*** | (2006.01) |

(52) U.S. Cl.
CPC ..... *E04B 2/7424* (2013.01); *E04F 11/1853* (2013.01); *E04H 17/165* (2013.01); *E05Y 2800/122* (2013.01)

(58) Field of Classification Search
CPC .. E04F 11/1853; E04B 2/7422; E04B 2/7425; E04B 2/7433; E04B 2/7435
See application file for complete search history.

(56) References Cited

U.S. PATENT DOCUMENTS

2012/0181497 A1* 7/2012 Carlsson ..... E04F 11/18 256/24
2019/0112817 A1* 4/2019 Karras ..... E04F 11/1853

FOREIGN PATENT DOCUMENTS

| | | | | |
|---|---|---|---|---|
| CN | 208925687 U | * | 6/2019 | |
| EP | 2395167 A1 | * | 12/2011 | ..... E04H 17/165 |
| EP | 2728080 A1 | * | 5/2014 | ..... E04B 2/827 |
| EP | 3808913 A1 | * | 4/2021 | |
| WO | WO-2017065712 A1 | * | 4/2017 | ..... E06B 3/44 |

* cited by examiner

*Primary Examiner* — Joshua T Kennedy
(74) *Attorney, Agent, or Firm* — R. Ruschena Patent Agent, LLC

(57) ABSTRACT

A movable screen for outdoor use, which can be folded when not in use, the movable screen is provided with a fixed bottom element and two movable elements, which slide vertically with respect to the fixed element. Each element is made of a transparent panel constrained by a frame made up of two vertical uprights. The movable screen has each one of the two movable elements being movable between a first and a second position, in which each one of the movable elements remains stable both in the first and second position without needing user interventions and in which the movable elements lifting occurs without user efforts but by using a gas spring. The screen has a very low visual impact, and allows a very safe and easy lifting and lowering operations of the screen movable portions.

9 Claims, 9 Drawing Sheets

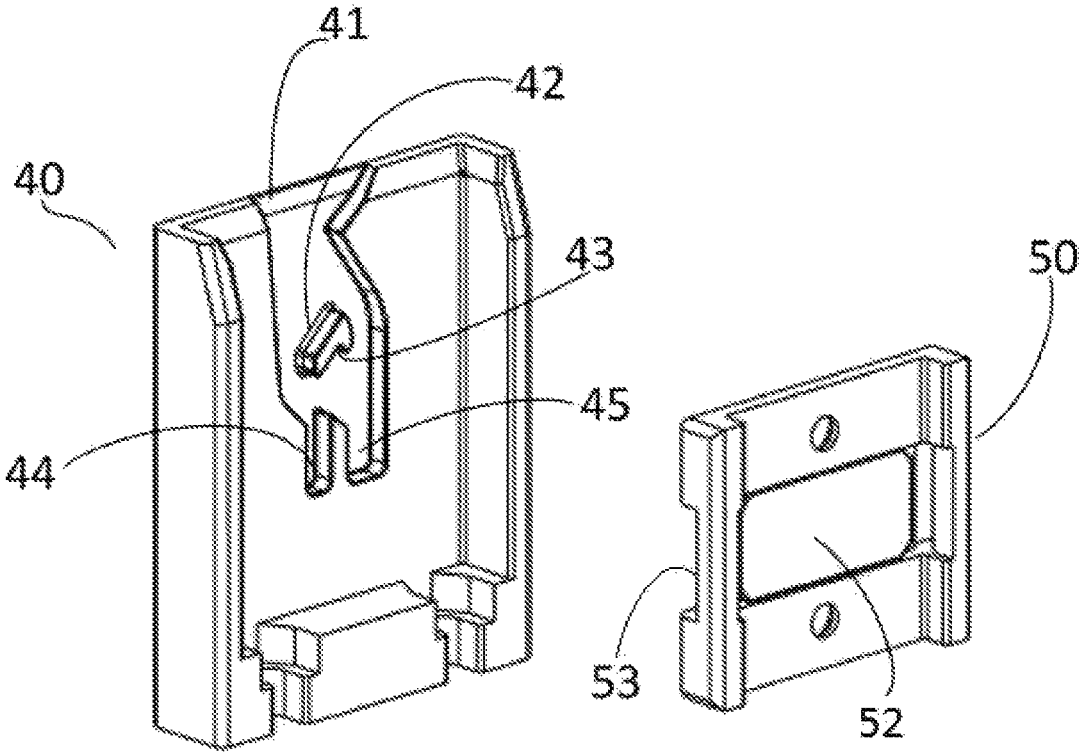
Fig. 9-a
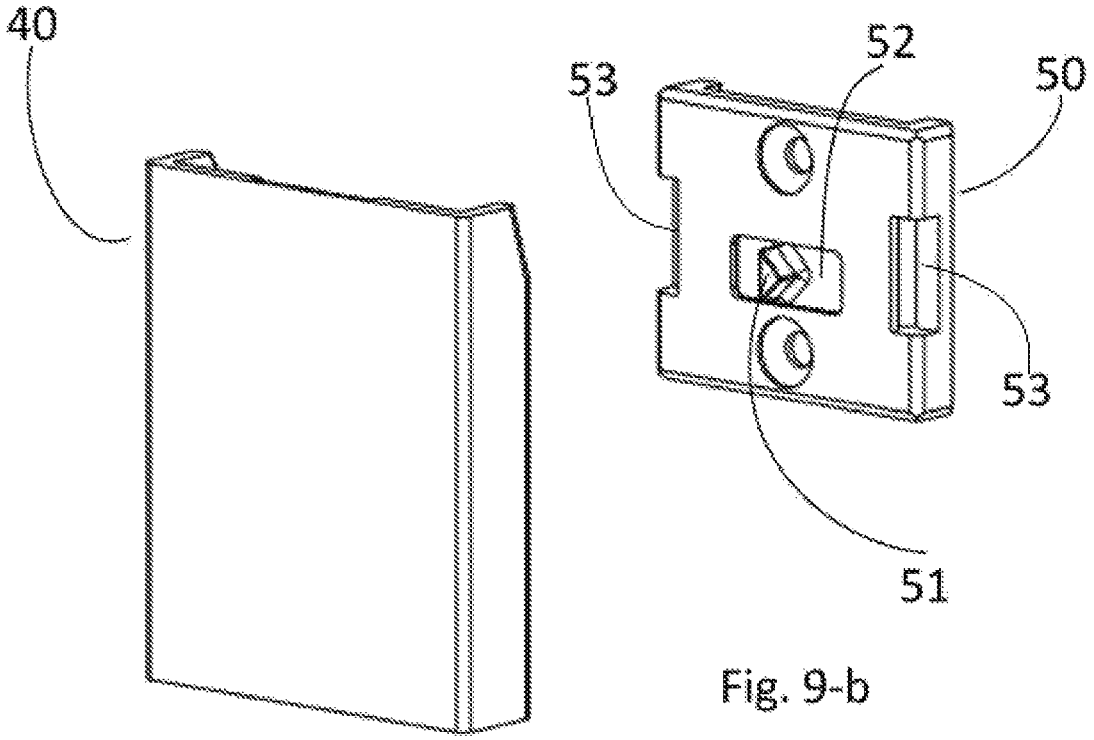
Fig. 9-b

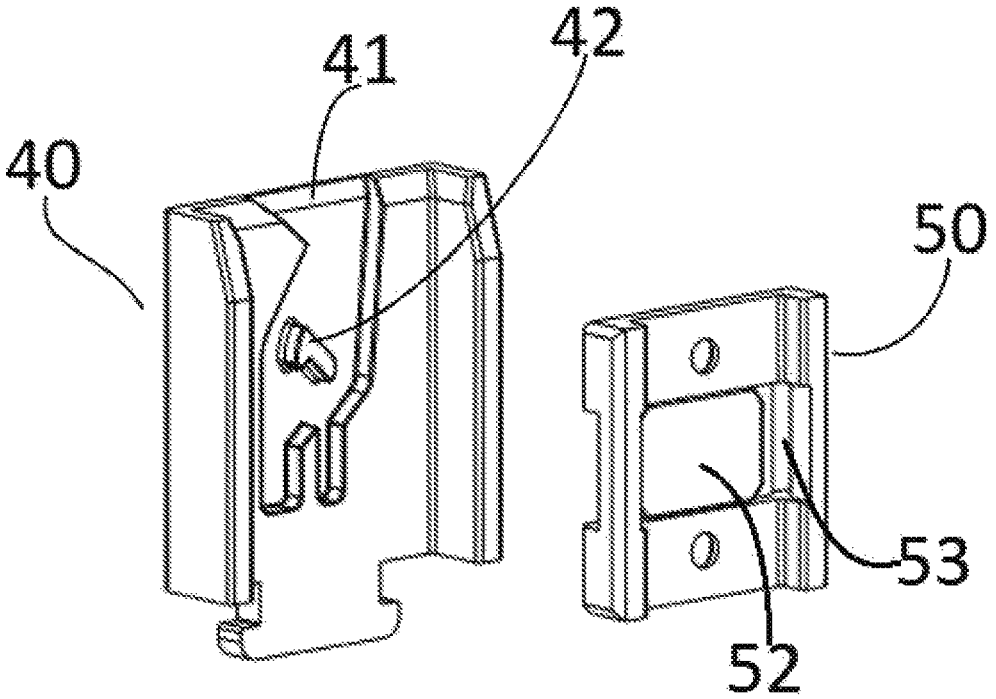
Fig. 10-a
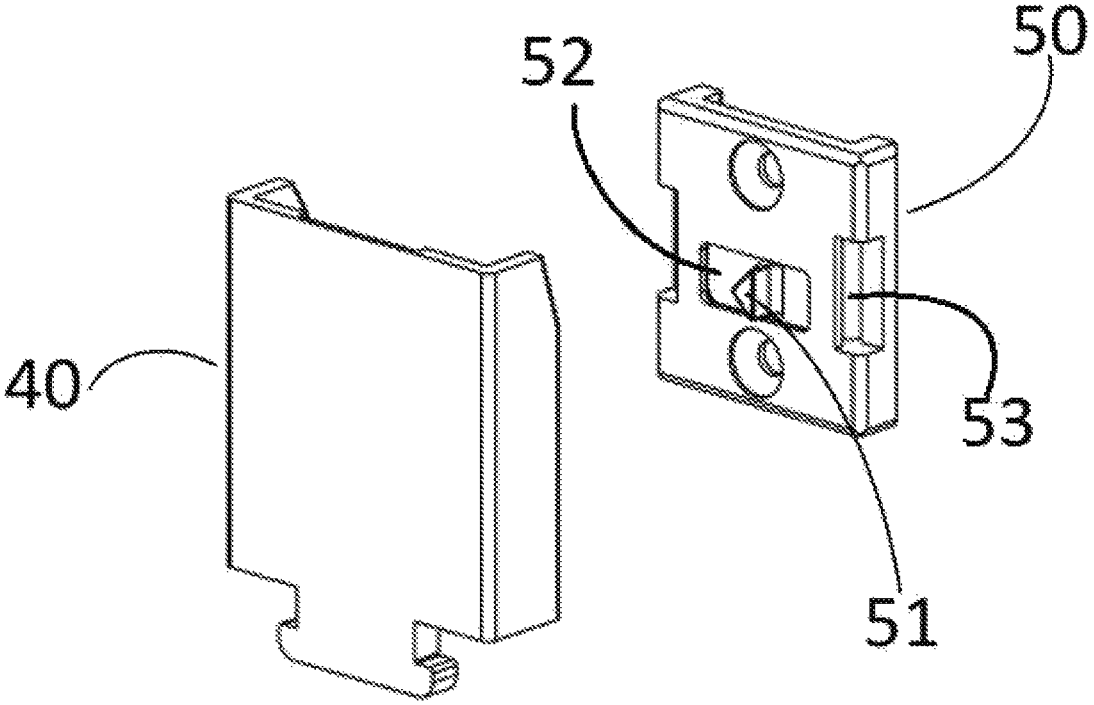
Fig. 10-b

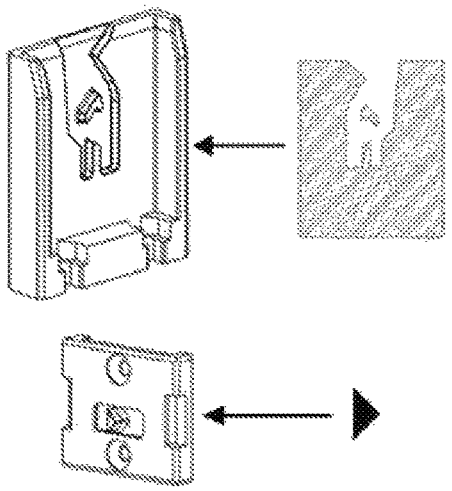
Fig. 11-a
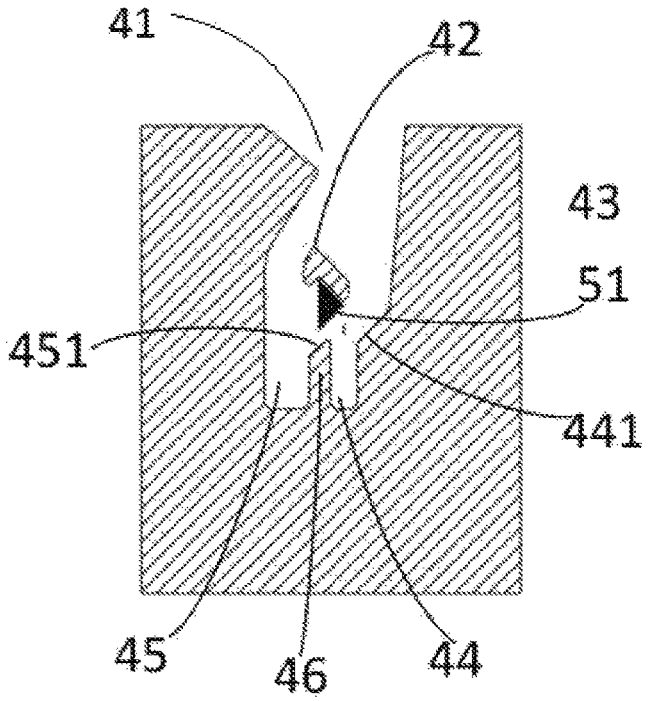
Fig. 11-b
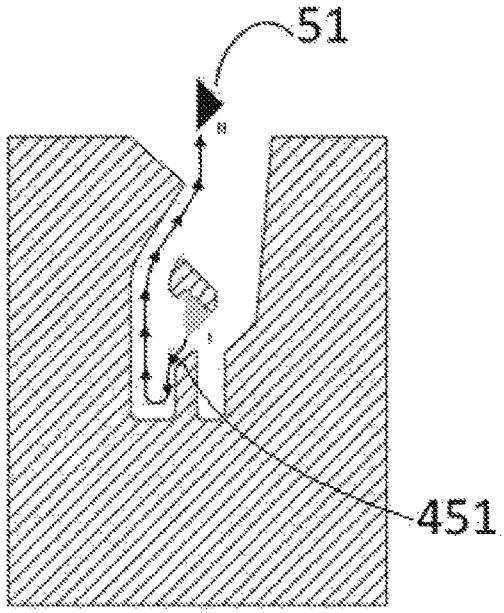
Fig. 11-c
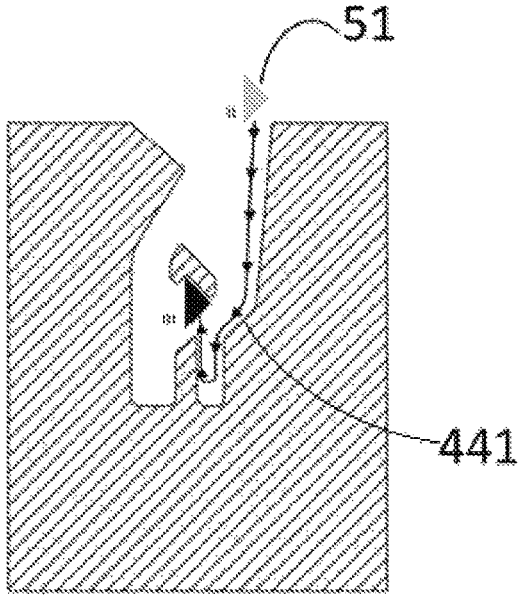
Fig. 11-d

MOVABLE SCREEN

BACKGROUND OF THE INVENTION

The present invention relates generally to a movable screen provided with an automatic coupling system.

1. Field of the Invention

At the state of the art there are known many embodiments of screen structures. They are generally vertical structures, typically installed outdoor, which allow a barrier to the wind, and are preferably transparent so that they do not represent a visual obstacle.

2. Brief Description of the Prior Art

In the Italian application MI2010A001060 it is described a modular screen, which comprises a bottom element, intended to keep the screen element upright and an upper element, which can be lifted and lowered to the bottom element. The bottom element and the upper element are made up of a frame with two uprights and two crosspieces enclosing a transparent panel, and the upper element uprights are housed by sliding in the lower element uprights by means of respective gas springs. The upper element uprights are made up of section bars whose outer outline corresponds perfectly to the inner outline of a corresponding seat provided in the lower element upright.

Another embodiment marketed by Aluminco consists in a movable screen comprising a lower base and an upper element, which is movable by sliding relative to the same and which is provided with a frame made up of uprights only, without reinforcement crosspieces.

Yet, another embodiment is described in the utility Patent application ITPR20040010, in which it is described a screen with a latch system where the upper panel, which slides relative to the lower panel, is moved by means of a crank installed on one of the crosspieces of the lower element frame. Other embodiments, substantially similar to the just described ones, are known on the market and produced for example by Durasol Awnings, Plateatico and Glasscon.

According to the disclosure of the present applicant, all the screens known at the state of the art comprise no more than two elements, one of which being movable in vertical direction only, and which are provided with various actuation systems (typically spring or crank systems).

SUMMARY OF THE INVENTION

An aim of the present invention is to provide a movable screen for outdoor use, which can be folded when not used in order to make its dimensions and aesthetic impact lower to the known embodiments; which can be lifted up to a height useful to protect the area intended to be sheltered from the wind; which has a very low frame visual impact (and in particular, which does not provide the use of crosspieces but only the use of uprights, which allows very safe and easy lifting and lowering operations of the screen movable portions.

Regarding the possibility of folding the screen as much as possible, an aim of the present invention is to provide a movable screen provided with a fixed element and two movable elements, which slide vertically above the fixed element.

Regarding the visual impact reduction, an aim of the present invention is to provide a movable screen having a fixed element and two movable elements, which slide vertically relative to the fixed element, in which each element comprises a transparent panel constrained by a frame made up of two vertical uprights.

Regarding the lifting and lowering operations, an aim of the present invention is to provide a movable screen in which each one of the two movable elements is movable between a first and a second position, in which each one of said movable elements remains stable both in said first and second position without needing user interventions and in which said movable elements lifting occurs with no user effort but by means of a gas spring.

In particular, in order to reach the last aim it is needed that the movable screen is provided with a suitable automatic coupling and de-coupling system, whose functioning is described in detail in the following, which allows to lock and release the movable elements by means of a simple action when they are in their lowered position (a position in which they are subjected anyway to the action of the gas spring, which would tend to lift them).

The present invention achieves the prefixed aims since it is a screen resulting in partitions for outdoor use, comprising: a fixed bottom element (10); an intermediate element (20) vertically sliding relative to the first fixed element (10) between a first position, in which it projects almost completely in vertical direction to the first fixed element (10), and a second position, in which it is lowered down to overlap, in front view, to the first fixed element (10); a terminal movable element (30) vertically sliding relative to the intermediate element (20) between a first position, in which it projects almost completely, and a second position, in which it is overlapped, in front view, to the intermediate element (20), each one of the elements (10, 20, 30) comprising a transparent panel (11, 21, 31), a frame made up of a couple of vertical uprights (12, 22, 32), characterized in that the vertical uprights (12) of said first fixed element (10) comprise a through vertical recess (122), facing the screen center and such shaped and dimensioned that it houses the section bars (22) of the intermediate element (20) in a sliding manner, and the vertical uprights (22) of said intermediate element (20) comprise a through vertical recess (223), facing the screen center and such shaped and dimensioned that it houses the section bars (32) of the terminal element (30) in sliding manner.

These and other advantages will be clear by the detailed description of the invention, which will refer to the appended FIGS. 1 to 12.

BRIEF DESCRIPTION OF THE DRAWINGS

FIGS. 9 and 10 show the automatic panels coupling and decoupling.

FIG. 11 shows the functioning of the panels.

DETAILED DESCRIPTION OF THE PREFERRED EMBODIMENTS

Figure 1:
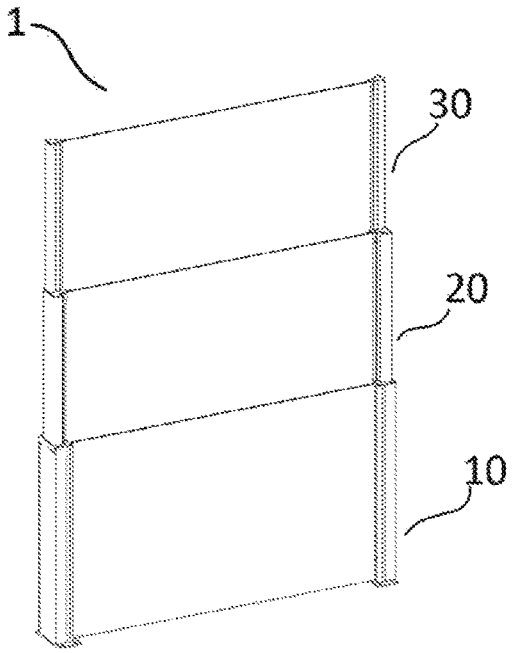
FIG. 1 shows an axonometric view of the screen according to the present invention, in completely lifted configuration.

With reference to the appended FIG. 1, it is observed that the screen (1) according to the invention comprises a fixed bottom element (10) and two movable elements (20, 30) vertically sliding relative to the first fixed element (10).

The intermediate element (20) slides between a first position (shown in FIG. 1), in which it projects almost completely in vertical direction to the first fixed element (10), and a second position (shown in FIG. 2), in which it is lowered down to overlap, in front view, to the first fixed element (10).

Figure 2:
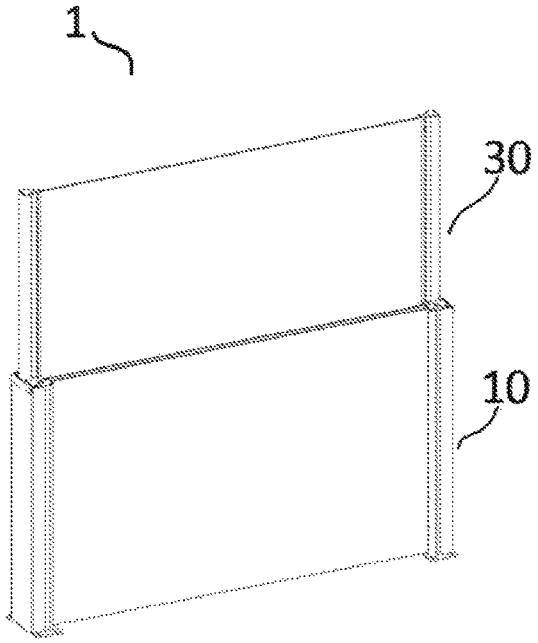
FIG. 2 shows a view of a partially lifted configuration of the screen.
Figure 3:
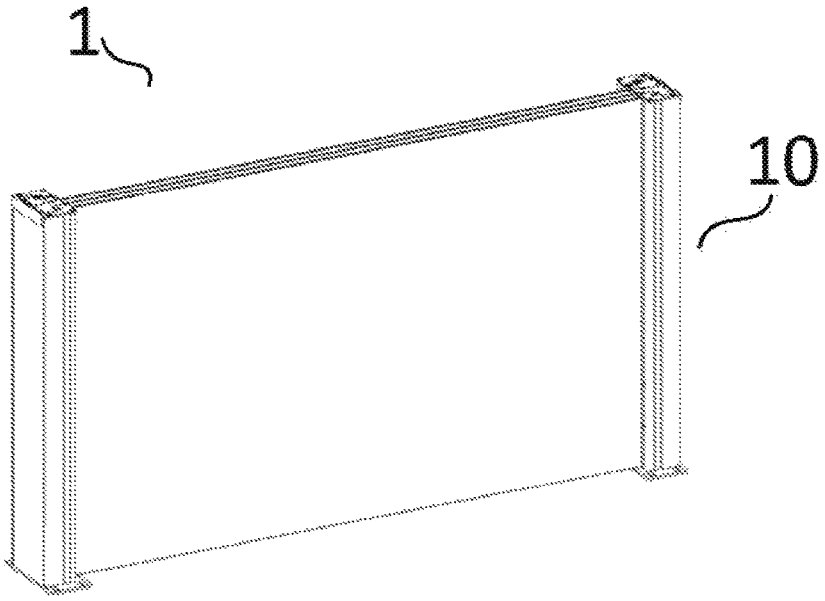
FIG. 3 shows a completely lowered configuration.

As it is shown in FIGS. 2 and 3, the upper movable element (30) can slide relative to the intermediate element (20) between a first position, in which it projects almost completely up, and a second position, in which it is overlapped, in front view, to the intermediate element (20).

Figure 4:
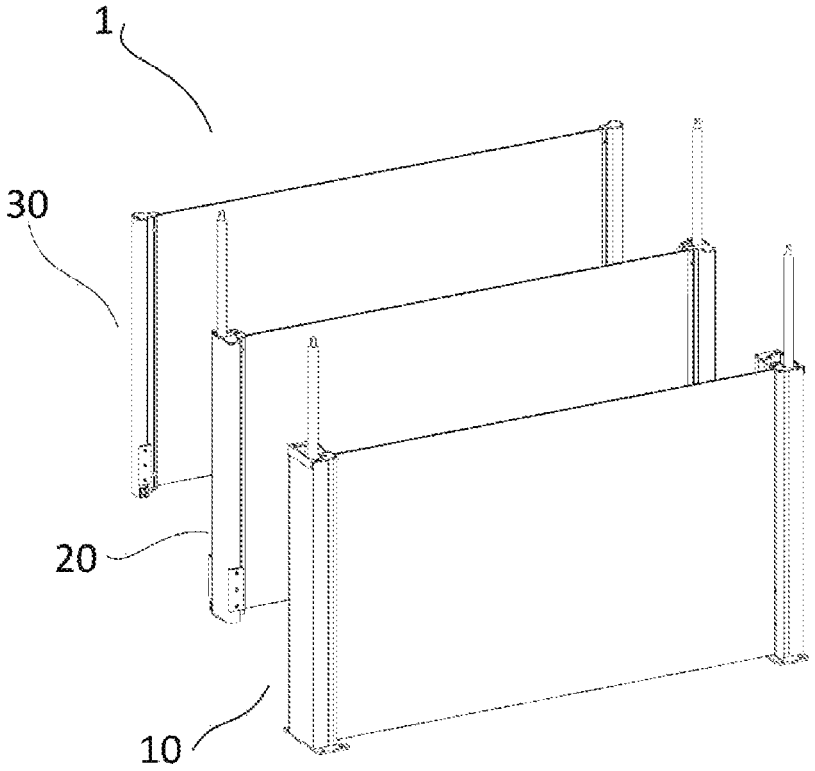
FIG. 4 shows an exploded view of the screen, in which three panels and respective fittings are shown disassembled to each other.

FIG. 4 shows the elements (10, 20, 30), which make up the screen, in an exploded view.

Figure 5:
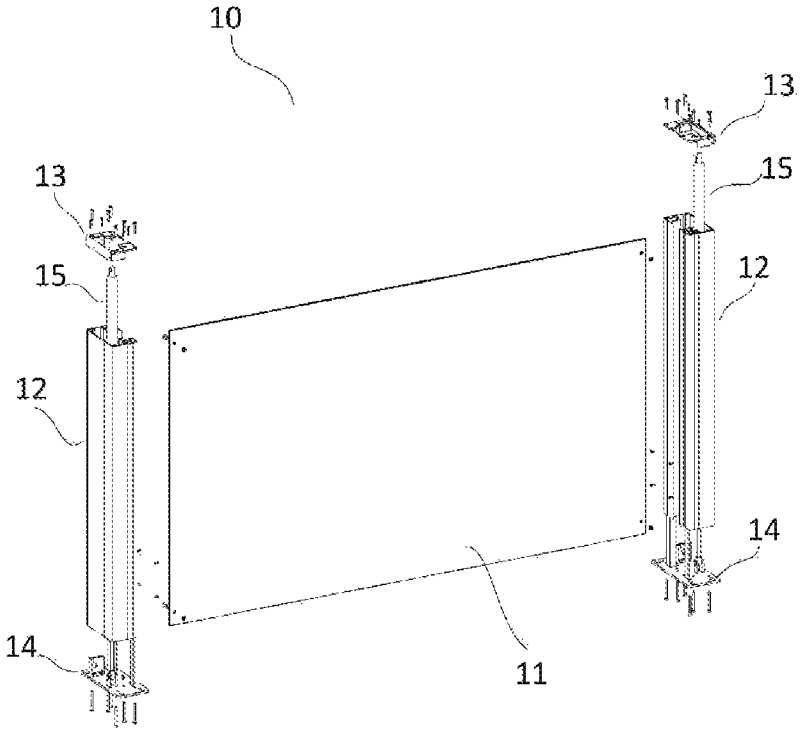
FIGS. 5, 6 and 7 show exploded views of the single panels.
Figure 6:
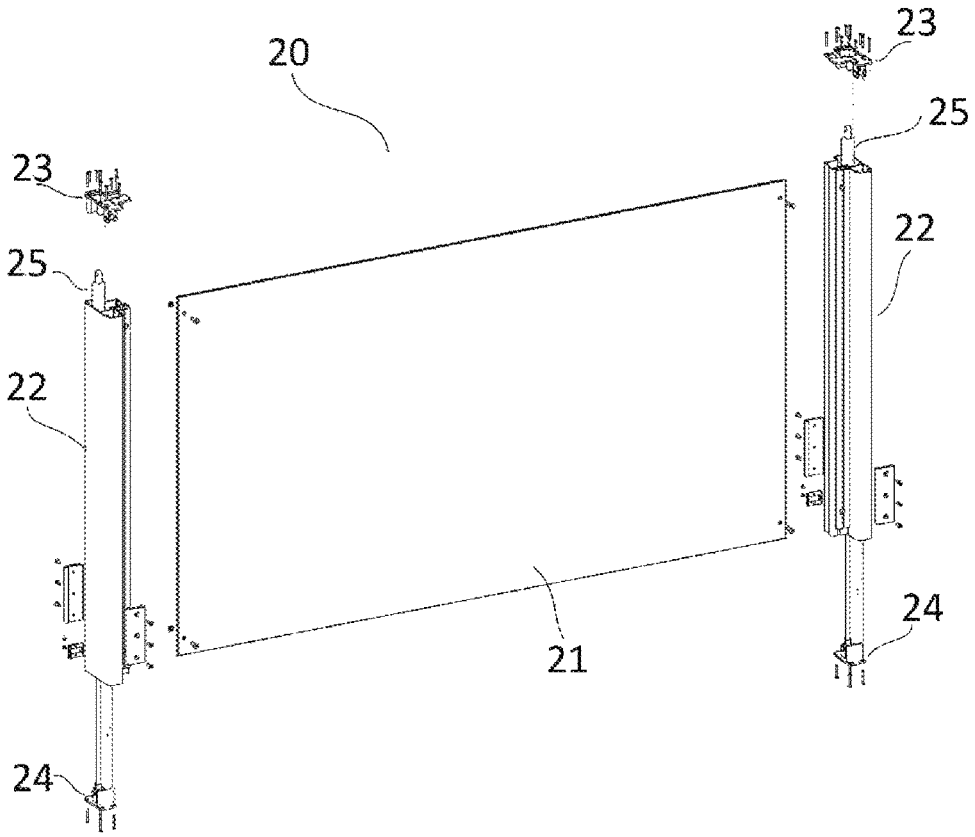
Figure 7:
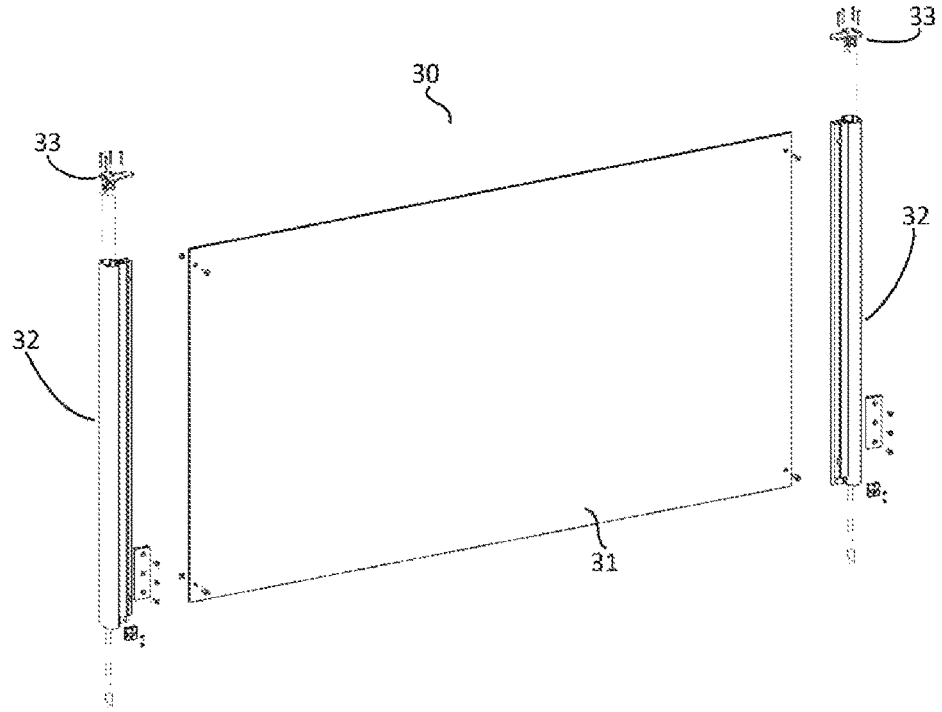

As it can be seen on FIG. 5, the fixed element (10) comprises a transparent panel (11) constrained to a frame made up of two profiled vertical uprights (12). The uprights (12) are provided with lower constraining plates (14) for attaching to the ground and upper plugs (13) closing partially the upper portion outline. Inside the uprights there are also provided gas springs (15) configured to lift the intermediate element (20).

The section bars (12) of the vertical uprights of the fixed element (10) comprise a housing (121) to house the transparent panel (11) and a through vertical recess (122), which is parallel to said housing, facing the screen center and such shaped and dimensioned that it houses the section bars (22) of the intermediate element (20) in a sliding manner. The gas springs (15) are positioned vertically inside the through recess and are configured so that they exert their force between the lower plates (14) and the intermediate element (20).

Figure 12:
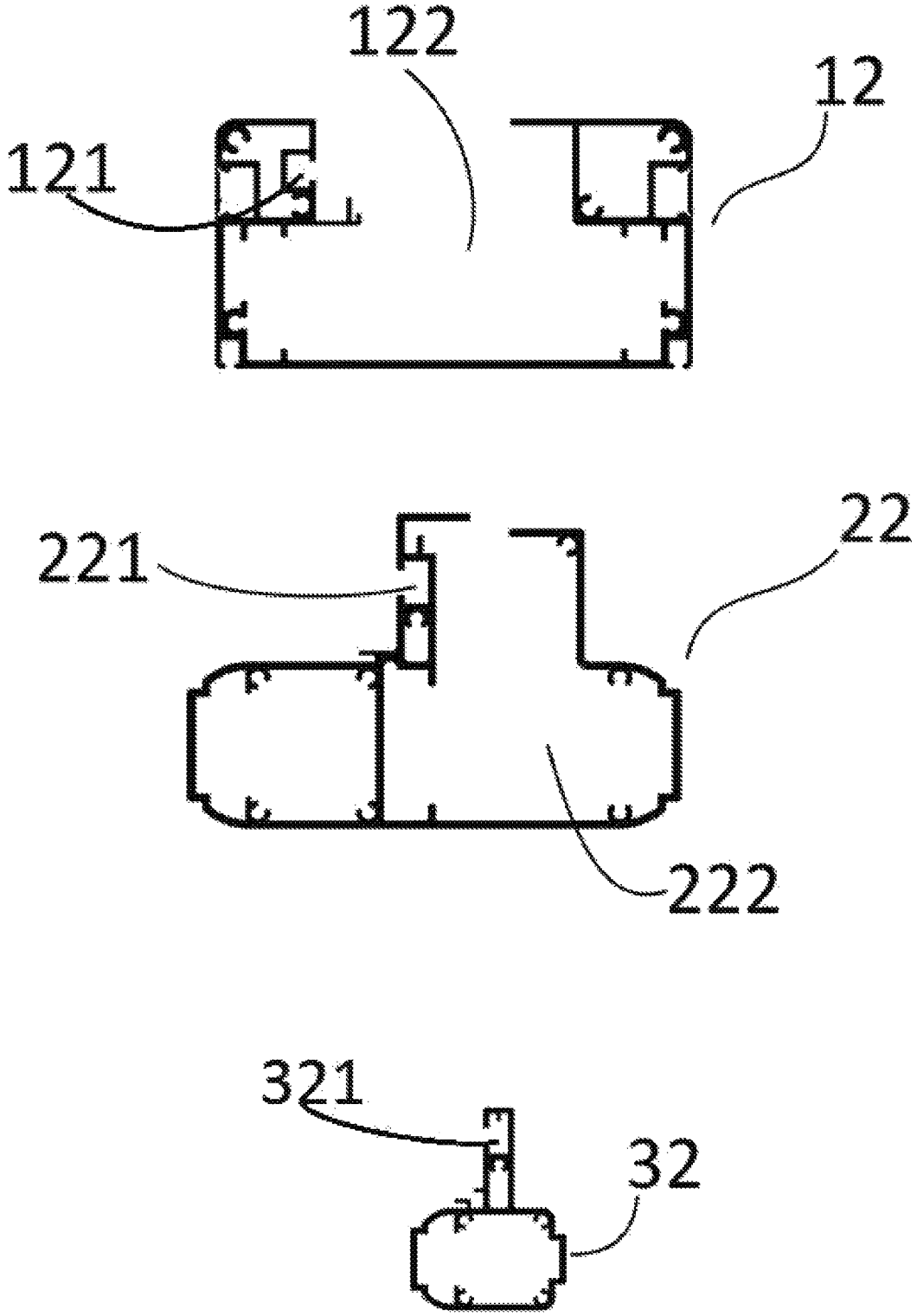
FIG. 12 shows a section view of each one of the section bars used to comlete the screen according to the invention.
Figure 13:
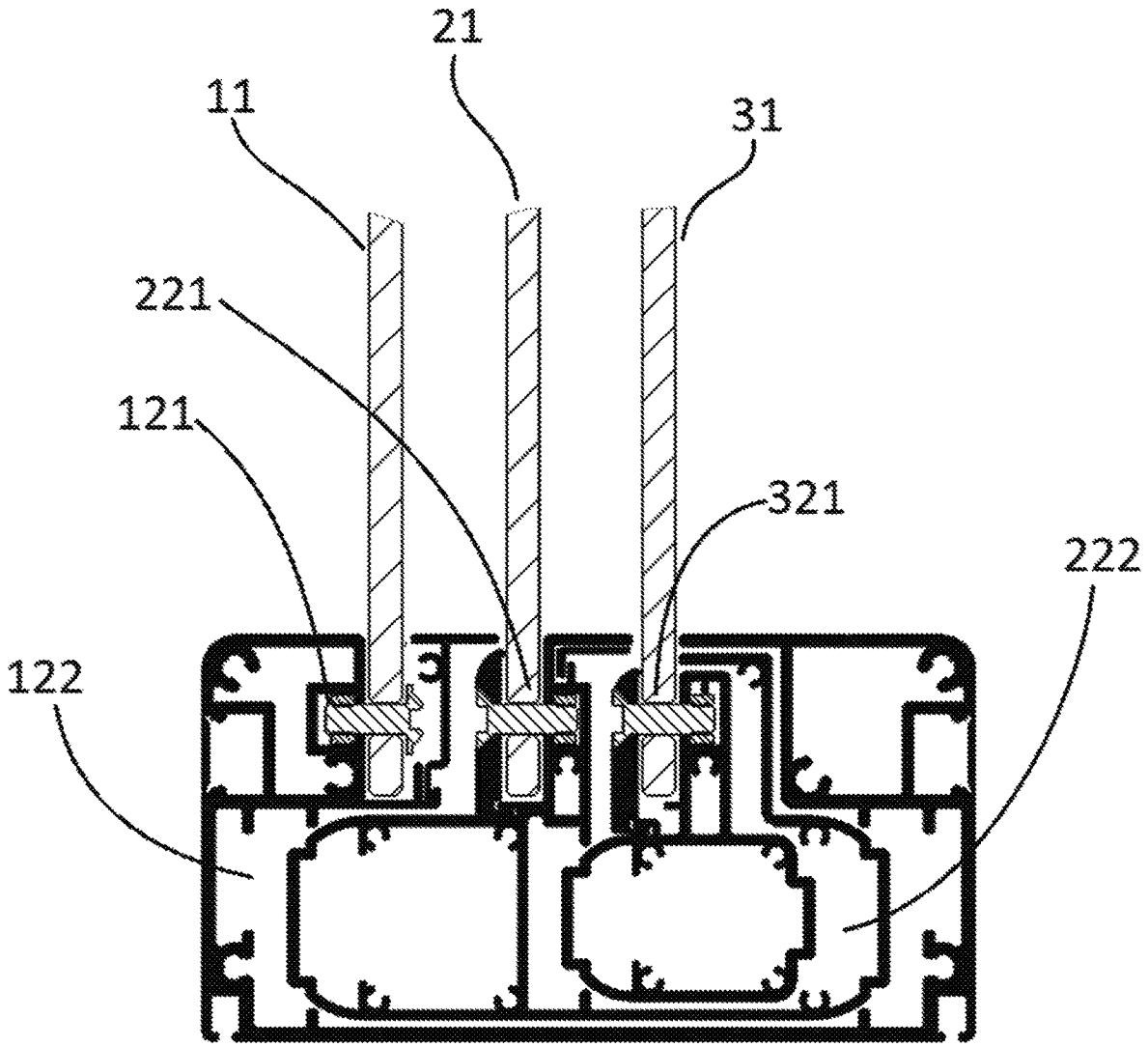
FIG. 13 shows a section view of the assembled section bars and highlights the transparent panels position.

As it is clear from the appended FIGS. 12 and 13, the housing (121) of the transparent panel is configured so that it houses the panel fixing screws, which, in addition to the section view of FIG. 13, are visible also in the exploded view of FIG. 5, and which engage through holes provided on the panel. Bushings, as it is shown in FIG. 5, can be possibly used for attaching the screws, or the screws can be threaded directly in the upright, As it is shown in FIG. 12, a flat abutting surface, which is parallel to the transparent panel plane, and against which the glass is pushed by clamping the screws, is provided immediately near and on both sides of the opening of the housing (121), in order to allow the panel constraint.

This measure allows to fix the panel integrally only by using vertical uprights, as it is shown in FIG. 5, contrary to what happens in the devices described on documents of prior art (as for example document EP2395167), where since the glass is siliconized inside the panels, it is needed the use a frame comprising four uprights, two vertical and two horizontal ones, a solution which is less attractive aesthetically.

The intermediate element (20) slides to said fixed element (10) as it is described in the following. The intermediate element (20) comprises a transparent panel (21) constrained to a frame made up of two profiled vertical uprights (22). The uprights (22) are provided with lower plugs (24) for closing the section bar in the lower portion and upper plugs (23) closing partially the outline of the upper portion. Inside the uprights (22) there are also provided gas springs (25) configured to lift the upper element (30). The section bars (22) of the vertical uprights comprise a housing (221) for the transparent panel (21) and a through vertical recess (222), parallel to the housing, facing the panel center and such shaped and dimensioned that it houses the outline of the terminal element (30) in a sliding manner. The gas springs (25) are positioned vertically inside the through recess and are configured so that they exert their force between lower plugs (24) and the terminal element (30). The outer profile of the uprights (22) is such that it can be housed slidingly inside the recess (122) provided in the uprights (12) of the fixed element (10).

The terminal element (30) slides relative to the intermediate element (20), as it is described in the following. The terminal element (30) comprises a transparent panel (31) constrained to a frame made up of two profiled vertical uprights (32).

These uprights (32) are provided with upper plugs (33) closing completely the outline of the upper portion. The section bars (32) of the vertical uprights comprise a housing (321) for the transparent panel (31). The outer profile of the uprights (32) is such that it can be housed slidingly inside the recess (222) provided in the uprights (22) of the intermediate element (20).

The shape of all the section bars is shown in section on FIG. 12. FIG. 13 shows the section bars assembled.

After describing all the elements of the screen according to the invention, it is now possible to describe their functioning.

When the screen is in a completely lifted position, as it is shown in FIG. 1, the forces exerted by the gas springs (15, 25) are such that they keep the intermediate element (20) and the terminal element (30) stably in position. To such aim, each one of the two springs is set to exert a slightly higher force than the weight it has to overcome.

Switching now from. the completely lifted configuration of FIG. 1 to the intermediate configuration of FIG. 2, it is sufficient to apply a vertical force downwards to the intermediate panel (20), to bring the intermediate element in the position, of FIG. 2, In this position the intermediate element (20) remains automatically constrained thanks to the automatic coupling system (whose functioning is described in detail in the following).

From this position, in order to lift again the intermediate element (20) it is sufficient to exert a new force downwards so that the coupling system is released, and to allow that the force of the gas spring (15) brings the element (20) again in the completely open position.

The terminal element (30) has an analogous functioning. From the partially lifted configuration shown in FIG. 2, in order to switch to the completely lowered configuration of FIG. 3, it is sufficient to exert a force downwards on the terminal element, to bring it in the position of FIG. 3, in which the terminal element remains automatically locked.

From this position, in order to lift the terminal element (30) again it is sufficient to exert a force downwards again so that the element is slightly lowered, so that the coupling system is released, and the gas spring (25) force is allowed to bring again the terminal element (30) in the completely open position.

Figure 8:
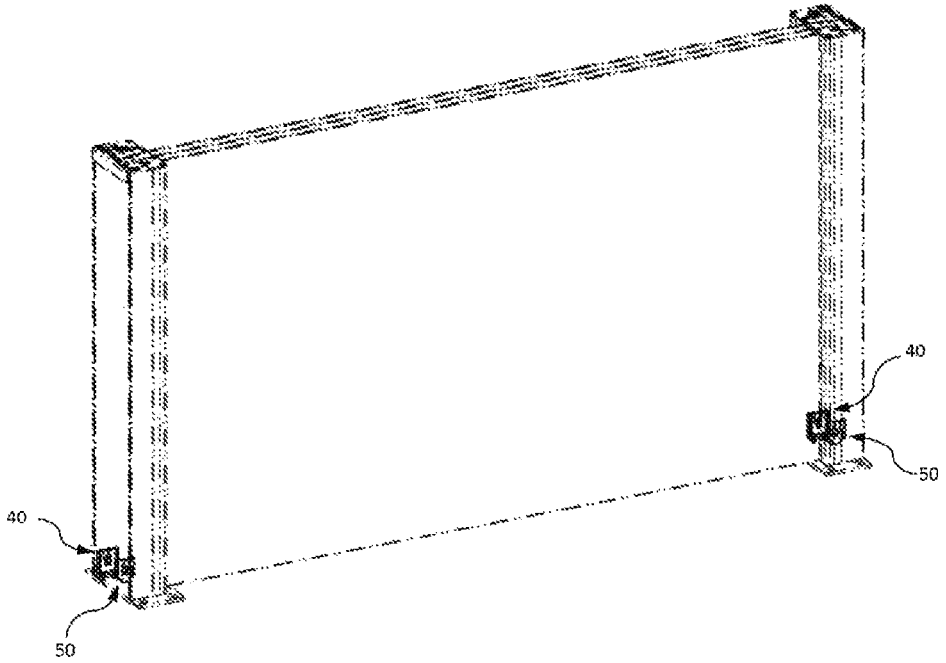
FIG. 8 shows an axonometric view of the panel in its completely lowered configuration, in which the elements shown, using dashed lines, allow to individuate the position of the coupling and decoupling systems.

The functioning of the coupling system is shown in FIGS. 8 to 11. FIG. 8 shows the position of the constraining system inside the section bars. As it is shown in FIG. 9, the constraining system is made up of a fixed plate (40) and a movable plate (50).

The fixed plate (40) is "C" shaped, and is provided with a shaped recess (41) positioned on the central side of the plate and facing the center of the same, described in detail in the following. Inside the recess (41) it is provided a stop element (42) provided with a concavity (43) facing downwards. The movable plate (50) is configured so that it can slide vertically inside the two sides of the "C" section of the fixed plate (40). Moreover, the movable plate (50) is provided with a slider (52) provided with a projection (51) with a triangular section. The slider (52) is such shaped and dimensioned that said triangular projection (51) slides horizontally inside a through recess (53) provided on the movable plate (50).

The fixed plate (40) and the movable plate (50) are configured such that, when said triangular projection (51) is engaged in said concavity (43), after a movement downwards of the movable plate (50), the projection (51) is translated in horizontal direction so that it can slide upwards without engaging again in said concavity (43).

In addition, the plates are configured so that, when said movable plate (50) slides upside down to said fixed plate (40), the triangular projection (51) is translated horizontally such that it engages in said concavity (43) in the next movement upwards.

The fixed and movable plates are constrained to elements which slide relative to each other: in a first coupling the fixed plate (40) is constrained to the upright of the fixed element (10) at the closing plate (14) and the movable plate (50) is constrained in the lower portion to the upright of the intermediate element (20); in a second coupling the fixed plate (40) is constrained to the upright (22) of the intermediate element (20) at the closing plate (24) and the movable plate (50) is constrained to the lower portion of the upright (32) of the terminal element (30). In any case, the plates are mounted so that the triangular projection (51) of the slider (52) of the movable plate (50) faces the fixed plate (40).

With reference to FIG. 11-*b*, it is to be noted that the recess (41) of the fixed plate is shaped so that in the lower portion it has a first channel (44) and a second channel (45) separated by a partition (46). In the upper portion of the channels (44, 45) there are provided oblique surfaces (441, 451). Inside the recess it is also provided a stop element (42), shaped as a hook with the concavity (43) facing downwards.

In the locked system position, the movable plate is in the position as shown on FIG. 11-*b*, with the projection (51) locked in the concavity (43) of the hooked stop element (42). The force of the gas spring pushes the movable plate—which is constrained to the intermediate element (20) or the terminal element (30)—upwards and avoids the movable plate movement.

By moving the movable plate; downwards, the oblique surface (451) invites the projections (51) in the second vertical channel {45}. It is to be remembered that the movable plate can slide horizontally relative to the fixed plate.

When the outer force, which pushes the movable plate downwards, ends the gas spring moving upwards the element, which the movable plate (50) is integral to. By virtue of the horizontal translation the movable plate (50) is subjected to while moving downwards, the projection (51) is no more locked by the hooked element (42) and can go upwards, as it is shown by the arrows on FIG. 11-*c*.

This allows to lift the intermediate element (20) to the fixed element (10) automatically—or the terminal element (30) to the intermediate element (20).

If it is intended to bring again the elements in closed position, it is sufficient to exert a force downwards. The path of the movable plate (50) is shown by the arrows on FIG. 11-*d*. In this case, the oblique surfaces invite the projection (51) inside the first vertical channel (44). When the force downwards ends, the springs push again upwards the projection (51) which, in this case, will be locked inside the concavity (43) of the hooked element (42). Practically, this is the starting position again, starting from which the functioning of the two plates has been described.

In this way the automatic coupling of the terminal element (or intermediate element) is obtained by means of a simple application of force downwards. Preferably, but non limitingly, when the device is mounted to delimit a space (as for example dehors of a bar or a restaurant), the mounting direction is such that the transparent panel (31) of the terminal module (30) is outside the panel (21) of the intermediate module (20), which in turn, is outside the fixed panel (11). Obviously, inner means the side facing the delimited space and outer means the side opposed thereto.

In this way, rain pouring on the terminal module or intermediate module cannot drip inside the delimited space, but only outside.

It is to be noted that the screen (1) described and shown on the figures is to be intended as a modular element useful for partitions for outdoor use, comprising a plurality of screens (1) arranged side by side and/or angularly, according to the particular mounting needs.

It is also to be noted that even if panels (11, 21, 31) are always shown flat, the screen (1) according to the invention can be made, without any variation of the described mechanism, with angular panels, preferably comprising two surfaces arranged orthogonally therebetween.

Yet, another embodiment consists in achieving parapets or balustrades by using side by side one or more devices according to the invention. To such aim the uprights of the fixed module can be conveniently dimensioned to withstand loads, which parapets and balustrades are to be checked to.

The invention claimed is:

1. A screen (1) for partitions for outdoor use, comprising:

a fixed bottom element (10);

an intermediate element (20) vertically sliding relative to said first fixed bottom element (10) between a first position, in which said intermediate element (20) slides almost completely in vertical direction from said first fixed bottom element (10), and a second position, to which said intermediate element (20) is lowered down to overlap to said first fixed bottom element (10);

an upper movable element (30) vertically sliding relative to said intermediate element (20) between a first position, in which said upper movable element (30) slides almost completely upward, and a second position, in which said upper movable element (30) overlaps said intermediate element (20), each one of said elements (10, 20, 30) comprising a transparent panel (11, 21, 31) attached to a frame made up of two vertical uprights (12, 22, 32), and wherein each one of said vertical uprights (12, 22, 32) comprises a housing (121, 221, 321) configured to allow attaching said transparent panel (11, 21, 31), to a flat abutting surface, adjacent at both sides to said housing (121, 221, 321) and positioned in parallel direction to each transparent panel (11, 21, 31);

and wherein said each vertical upright of said first fixed bottom element (10) comprise a through vertical recess (122), facing a screen center, said vertical recess (122) is shaped and dimensioned to house section bars (22) of the intermediate element (20) in a sliding manner, and the vertical uprights (22) of said intermediate element (20) comprise a through vertical recess (222), facing the screen center and such shaped and dimensioned to house section bars (32) of the terminal element (30) in a sliding manner.

2. The screen (1) for partitions for outdoor use according to claim 1, comprising a first and a second set of two gas springs (15, 25), respectively arranged inside the section bars (12, 22) of said fixed element (10} and said intermediate element (20), said first set of two gas springs (15) being positioned vertically inside said through vertical recess of fixed bottom element (122) and being configured to exert its own force between lower closing plates (14) of the section bar (12) of the fixed bottom element (10) and a closing plate (23) of the intermediate element (20), and said second set of two gas springs (25) being positioned vertically inside said through vertical recess of intermediate element (222) and configured to exert its force between the lower closing plugs (24) of section bars (22) of the intermediate element (20) and a closing plate (33) of the upper element (30).

3. The screen (1) according to claim 2, further comprising an automatic constraining and coupling system of said upper element (30) to said intermediate element (20), said constraining system comprising a fixed plate (40) integral to said intermediate element (20), and a movable plate (50) integral to said upper element (30), said movable plate (50) being provided with a slider (52) provided with a projection (51} with a triangular section horizontally sliding inside a through recess (53) provided on the movable plate (50), and wherein said fixed plate (40) comprises a shaped recess (41) and a stop element (42) provided with a concavity (43) facing downwards, said shaped recess (41) and said triangular projection (51) being configured so that, when said triangular projection (51) is engaged in said concavity (43), after a movement downwards of the movable plate (50), the triangular projection (51) is translated horizontally so that it can slide upwards in the following without engaging again in said concavity (43).

4. The screen (1) according to claim 3, wherein said shaped recess (41) and said triangular projections (51) are also configured so that, when said movable plate (50) slides upside down to said fixed plate (40), said triangular projection (51) is translated horizontally so that engages in said concavity (43) in a next movement upwards.

5. The screen (1} according to claim 4, further comprising an automatic constraining and coupling system of said intermediate element (20) to said fixed bottom element (10), said constraining system being made up similarly to the constraining system provided between said upper element (30) and said intermediate element (20).

6. The screen (1) according to claim 1, wherein said transparent panels (11, 21, 31) are flat.

7. The screen (1) according to claim 1, wherein said transparent panels (11, 21, 31) are angular panels.

8. A partition for outdoor use comprising a plurality of screens (1) according to claim 1, arranged side by side or angularly according to user's preferences.

9. A parapet comprising a plurality of partitions according to claim 8.

* * * * *